United States Patent [19]

Kolaczinski et al.

[11] 4,154,371

[45] May 15, 1979

[54] DISPENSING CONTAINER

[75] Inventors: Gerhard Kolaczinski, Düsseldorf-Oberkassel; Georg Wiegner, Viersen, both of Fed. Rep. of Germany

[73] Assignee: Henkel Kommanditgesellschaft auf Aktien, Düsseldorf-Holthausen, Fed. Rep. of Germany

[21] Appl. No.: 779,176

[22] Filed: Mar. 18, 1977

[30] Foreign Application Priority Data

Mar. 19, 1976 [DE] Fed. Rep. of Germany ..... 2611644

[51] Int. Cl.[2] ..... B05B 11/04

[52] U.S. Cl. ..... 222/212; 222/494

[58] Field of Search ..... 222/212, 387, 494, 491, 222/556, 209

[56] References Cited

U.S. PATENT DOCUMENTS

| | | | |
|---|---|---|---|
| 2,161,230 | 6/1939 | Nelson | 222/494 X |
| 2,761,833 | 9/1954 | Ward | 222/212 X |
| 2,957,501 | 10/1960 | Holmes | 222/212 X |
| 3,088,636 | 5/1963 | Spatz | 222/494 X |
| 3,300,106 | 1/1967 | Chmela | 222/556 X |

*Primary Examiner*—Stanley H. Tollberg

*Attorney, Agent, or Firm*—Hammond & Littell

[57] ABSTRACT

A dispensing container with a piston forming the bottom of the container and being displaceable in the container, with a compressible container part, lying in front of the piston and having a mouthpiece, for withdrawal of the contents, of flexible and elastic material, and with a delivery valve opening on excess pressure in the container, the piston being secured by a blocking pawl against any displacement causing enlargement of the interior space of the container, particularly for dispensing a viscous cosmetic, such as toothpaste.

13 Claims, 5 Drawing Figures

FIG. 2
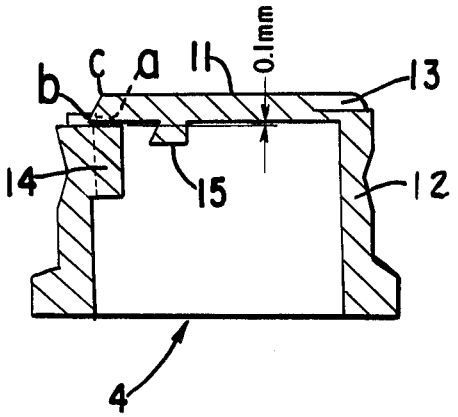
FIG. 3
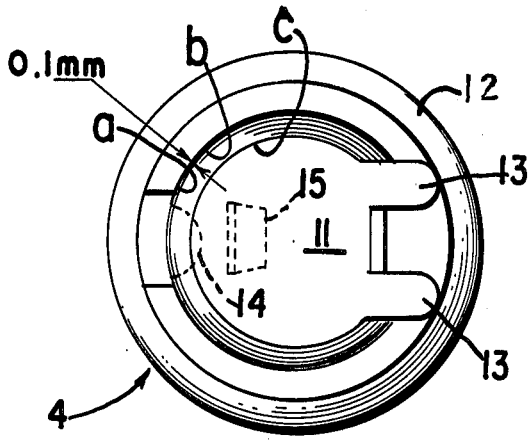
FIG. 4
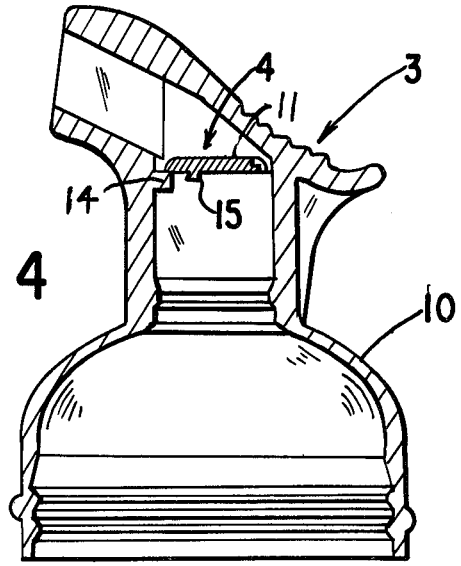
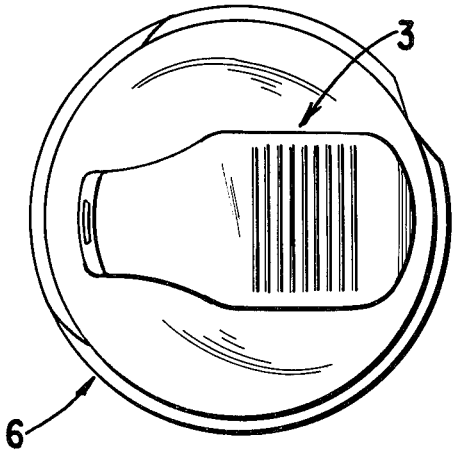
FIG. 5

DISPENSING CONTAINER

PRIOR ART

A dispensing container of the type of the present invention is disclosed in German (Fed. Rep.) Patent Specification No. 12 10 149. However, the non-return valve of this prior art container, which valve is arranged between the actual container and the exit opening, is not fully satisfactory in practice, especially with respect to reliable sealing. This prior art non-return valve is controlled under spring pressure. The problem with such a valve originates essentially from the fact that a valve of this construction is usable only when very careful attention is paid to individual details in its make-up, with the result that the valve is correspondingly expensive. Furthermore, the assembly of a non-return valve regulated under spring pressure is complicated.

OBJECTS OF THE INVENTION

An object of the present invention was therefore to improve the known dispensing containers by providing a valve means comprising a flap mounted in the container's mouthpiece by resilient hinge means openable by pressure in the container and closable by the resilience of the hinge means.

Another object of the present invention is the development of a dispensing container comprising a container body provided with a resiliently compressible portion including a mouthpiece at one end of said container, a piston member arranged in said container body at the other end to define a boundary of the interior space of the container, the piston member being movable towards and restrained from movement away from said compressible portion, and valve means comprising a flap, which is mounted in the mouthpiece by resilient hinge means and which in a closed position substantially fills out the interior cross-section of the mouthpiece, the flap being openable by pressure in the container and being closable by the resilience of the hinge means, and an abutment protruding into such interior cross-section to support the flap in its closed position.

These and other objects of the invention will become more apparent as the description thereof proceeds.

DESCRIPTION OF THE INVENTION

The drawbacks of the prior art dispenser were overcome and the above objects were achieved in a dispensing container, in particular for a viscous cosmetic, such as toothpaste, with a piston forming the bottom of the container and being displaceable in the container, with a compressible container part, lying in front of the piston and having a mouthpiece for withdrawal of the viscous cosmetic, or flexible and elastic material, and with a delivery valve opening on excess pressure in the container, the piston being secured by suitable means, such as a blocking pawl, against any displacement causing enlargement of the interior space of the container.

The invention, more particularly, resides in a dispensing container comprising a container body provided with a resiliently compressible portion including a mouthpiece, a piston member arranged in the container body to define a boundary of the interior space of the container, the piston member being movable towards and restrained from movement away from the compressible portion, and valve means comprising a flap, which is mounted in the mouthpiece by resilient hinge means and which in a closed postion substantially fills out the interior cross-section of the mouthpiece, the flap being openable by pressure in the container and being closable by the resilience of the hinge means, and an abutment protruding into such interior cross-section to support the flap in its closed position.

An economical manufacture of the container may be achieved by a one-piece construction of the valve means from synthetic material, which may suitably comprise a plastic substance. The valve can be shaped to be pot-like, so that it can be sealingly inserted with ease into a seating providied in the wall before the inlet cross-section of the mouthpiece. The pot bottom provides the flap, which just fills out the open inlet cross-section of the mouthpiece and which is resiliently hinged with a spring means to the side part, e.g. cylindrical part, of the pot. The valve is thus closed or opened according to the position of the flap. The flap can have various shapes, such as circular, elliptical, etc. The arrangement is designed to be of such construction that a small projection, against which the flap rests in the closed position, protrudes into the open cross-section of the valve. When a sufficient excess pressure is created in the container, said excess pressure overcomes the restraining spring force of the hinge means and the flap is pushed from its seating against the small projection. The diameter of the flap is preferably at most one centimeter for an area of $\frac{1}{4}\pi$ D or 0.8 sq. centimeter. The flap can also have a small projection extending inward toward the interior space of the container. Said projection is suitably located near and extends in a perpendicular direction in relation to the small projection against which the flap rests in its closed position.

The valve means can alternatively be integrally molded onto the mouthpiece. In this embodiment of the invention, the dispensing container, which comprises the container body provided with the resiliently compressible portion including a mouthpiece, the piston member arranged in the container body to define a boundary of the interior space of the container, the piston member being movable towards and restrained from movement away from the compressible portion, also comprises a valve means comprising a flap, which is integrally molded onto the mouthpiece of said resiliently compressible portion, said flap having resilient hinge means, and which in a closed position substantially fills out the interior cross-section of the mouthpiece, the flap being openable by pressure in the container and being closable by the resilience of the hinge means, and an abutment protruding into such interior cross-section to support the flap in its closed position. The flap can be designed like the previously described flap of the pot-like valve except that it is resiliently hinged to the wall of the mouthpiece.

The compressible portion advantageously consists of a thermoplastic elastomer, such as a polyester. This compressible portion of the container can be molded to or suitably seated on or in contact with the container body 6, such as by being screwed onto said container body 6. The container body 6 can consist of any appropriate material having sufficient rigidity to make it relatively incompressible. For example, known plastic materials having such property could be employed. The container body can have various shapes, e.g. cylindrical.

An embodiment of the present invention will now be more particularly described by way of example with reference to the figures of the accompanying drawings, in which:

FIG. 2 is a side vertical cross-sectional view, to an enlarged scale, through the valve means in the container of FIG. 1;

FIG. 3 is a planar view from above of the valve means of FIG. 2;

FIG. 4 is a side vertical cross-sectional view of the upper portion of the container of FIG. 1, with modified valve means; and FIG. 5 is a planar view from above of the upper portion of the container.

Figure 1:
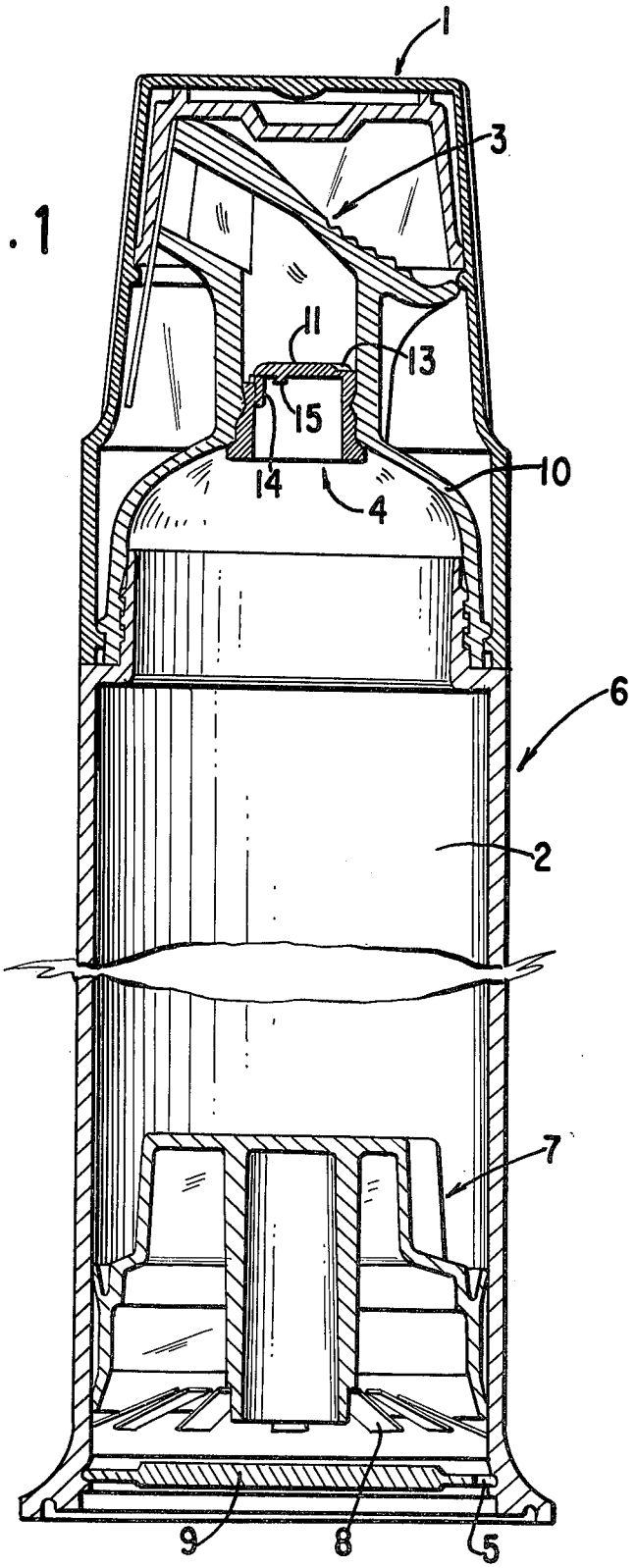
FIG. 1 is a side vertical cross-sectional view through the container of the invention.

In FIGS. 1 to 3 and 5 of the drawings, there is shown a dispensing container comprising a container body 6, in which is placed a displaceable piston 7 forming a bottom. A compressible container part 10, with a withdrawal mouthpiece 3, of flexible and elastic synthetic material lies in front of the piston 7. Also present is a delivery valve 4, which opens on excess pressure inside the container body 6. The piston 7 is secured by a blocking pawl 8 against any displacement causing enlargement of the interior space 2 of the container. A closure cap 1 is placed on the container body 6, and the container body 6 is closed behind the piston 7 by a disc 9 with a ventilation opening 5.

The delivery valve 4 (FIGS. 2 and 3) is integrally constructed and consists of synthetic material, which is suitably a plastic substance. It is placed in front of the inlet cross-section of the mouthpiece 3 and seals off the interior space 2. The delivery valve 4 is generally pot-shaped, the pot bottom of the valve being constructed as a circular valve flap 11. The flap 11 is hinged by a hinge 13 to a cylindrical part 12 of the valve 4 and substantially fills out the open cross-sectional space of the valve 4 at its end. The hinge 13 is constructed in such a manner that it exerts a spring action to hold the flap 11 (FIG. 2) closed. A projection 14, against which the flap 11 rests in its closed position, protrudes into the open cross-sectional space opposite the hinge 13. When excess pressure is induced in the container, the flap 11 is removed from its seating against the spring force of the hinge 13. Another projection 15 extends below the flap 11 substantially opposite projection 14 when the flap 11 is in the closed position. The diameter of the flap 11 is 7 millimeters. A gap of 0.1 mm is present between flap 11 and projection 14 and between flap 11 and cylindrical part 12 of the valve 4 (FIGS. 2 and 3).

FIG. 4 shows a modified valve 4, wherein the valve flap 11 is integrally molded onto the container part 10. Merely for clarification, the valve 4 is hatched differently to the part 10.

When the container part 10 is pressed in, the product in the container is pressed out of the mouthpiece 3 and can, for example, be applied to a toothbrush in the case where the product is toothpaste. After the temporary inward pressure has been discontinued, the container part 10 again assumes its original shape and valve 4 closes. The underpressure resulting therefrom effects an automatic follow-up of the piston 7 to bring about a reduction in the volume of the interior space 2 of the container in relation to the volume of the space before the inward pressure. The valve flap 11 is lifted off from its seating during the pressing out of the product and permits the passage of the product through the mouthpiece 3. After the pressure on the container part 10 has been discontinued, the flap 11 closes and prevents the entrance of air into the container part 10 or the interior space 2 of the container.

This process can be repeated until all or substantially all the product in the container has been dispensed.

The non-return valve in the container hereinbefore described is relatively economical to produce and assemble, and functions more reliably than the valve in the abovementioned known container.

The preceding specific embodiment is illustrative of the practice of the invention. It is to be understood, however, that other expedients known to those skilled in the art, or disclosed herein may be employed without departing from the spirit of the invention or the scope of the appended claims.

We claim:

1. A dispensing container for dispensing a viscous cosmetic product such as toothpaste comprising a container body provided with a resiliently compressible portion including a mouthpiece at one end of said container body, a piston member arranged in said container body at the other end to define a boundary of the interior space of the container, the piston member being movable towards and restrained from movement away from said compressible portion, and valve means comprising a flap having an area of at most 0.8 square centimeters, which is mounted in the mouthpiece by resilient hinge means and which in a closed position substantially fills out the interior cross-section of the mouthpiece, the flap being slightly spaced from the wall defining the interior cross section of the mouthpiece except at the area of mounting and openable by pressure on said resiliently compressible portion of the container and being closable by the resilience of the hinge means, and an abutment protruding into such interior cross-section to support the flap in its closed position.

2. The dispensing container of claim 1, wherein the flap is circular.

3. The dispensing container of claim 1, wherein the valve means comprises a synthetic material.

4. The dispensing container of claim 1, wherein the valve means is molded as a one piece component.

5. The dispensing container of claim 4, wherein the valve means further comprises a cylindrical portion arranged in the mouthpiece, the flap being integrally molded with and connected by a hinge to one end of the cylindrical portion.

6. The dispensing container of claim 1, wherein the valve means is molded integrally with the mouthpiece.

7. The dispensing container of claim 1, wherein the abutment is placed opposite the hinge means.

8. The dispensing container of claim 1, wherein the piston is restrained against movement away from the compressible portion by pawl means.

9. The dispensing container of claim 1, wherein the compressible portion consists of a thermoplastic elastomer.

10. The dispensing container of claim 9, wherein the thermoplastic elastomer is a polyester.

11. The dispensing container of claim 1, wherein the container body is substantially cylindrical.

12. A dispensing container for dispensing a viscous cosmetic product such as toothpaste comprising a container body provided with a resiliently compressible portion including a mouthpiece at one end of said container body, a piston member arranged in said container body at the other end to define a boundary of the interior space of the container, the piston member being movable towards and restrained from movement away from the compressible portion, and valve means comprising a flap, having an area of at most 0.8 square centimeters, which is integrally molded onto the mouthpiece of said resiliently compressible portion, said flap having resilient hinge means, said flap in a closed position substantially filling out the interior cross-section of the mouthpiece, the flap being slightly spaced from the wall defining the interior cross section of the mouthpiece except at the area of mounting and openable by pressure on said resiliently compressible portion of the container and being closable by the resilience of the hinge means, and an abutment protruding into such interior cross-section to support the flap in its closed position.

13. The dispensing container of claim 12, wherein the container body is substantially cylindrical.

* * * * *